US006802141B2

(12) United States Patent
Walther

(10) Patent No.: US 6,802,141 B2
(45) Date of Patent: Oct. 12, 2004

(54) IRON WITH SURGE STEAM FUNCTION

(75) Inventor: Harald Walther, Michelstadt (DE)

(73) Assignee: Rowenta Werke GmbH, Offenbach (DE)

( * ) Notice: Subject to any disclaimer, the term of this patent is extended or adjusted under 35 U.S.C. 154(b) by 0 days.

(21) Appl. No.: 10/399,768

(22) PCT Filed: Oct. 12, 2001

(86) PCT No.: PCT/IB01/01901

§ 371 (c)(1),
(2), (4) Date: Apr. 22, 2003

(87) PCT Pub. No.: WO02/34996

PCT Pub. Date: May 2, 2002

(65) Prior Publication Data

US 2004/0025382 A1 Feb. 12, 2004

(30) Foreign Application Priority Data

Oct. 24, 2000 (FR) ..... 00 13647

(51) Int. Cl.[7] ..... D06F 75/18
(52) U.S. Cl. ..... 38/77.83
(58) Field of Search ..... 219/254; 38/77.5, 38/77.7, 77.8, 77.82, 77.9, 82, 93

(56) References Cited

U.S. PATENT DOCUMENTS 2,700,236 A 1/1955 Marvin et al.
3,919,793 A * 11/1975 Toft et al. ..... 38/77.83
5,279,054 A * 1/1994 Chasen ..... 38/77.7
5,718,071 A 2/1998 Zbriger
5,979,089 A * 11/1999 Bouleau et al. ..... 38/77.83

FOREIGN PATENT DOCUMENTS

| | | |
|---|---|---|
| DE | 44 30 548 | 2/1996 |
| EP | 0 342 302 | 5/1988 |
| EP | 0 621 365 | 4/1994 |
| FR | 1356984 | 7/1964 |
| FR | 2 254 669 | 7/1975 |
| FR | 2 740 787 | 5/1997 |

* cited by examiner

*Primary Examiner*—Ismael Izaguirre
(74) *Attorney, Agent, or Firm*—Browdy and Neimark, P.L.L.C.

(57) ABSTRACT

The second vapor circuit of the second vaporizing chamber has, along the heating element (201), and located at the top of the heating body, a top channel (222) directed from the chamber towards the rear of the sole plate, and connected to the bottom channel (223) going from the rear towards the point of the sole plate, situated under the heating body of the sole plate. The iron has a heating unit (2) with a heater element, this heating unit also having a first vaporizing chamber (210) used for normal ironing, and a second independent vaporizing chamber (220) used for obtaining a surplus of vapor, each of these chambers having a vapor circuit ending in a set of vapor orifices in the sole plate.

6 Claims, 2 Drawing Sheets

Figures 1A, 1B, 1C, 1D:
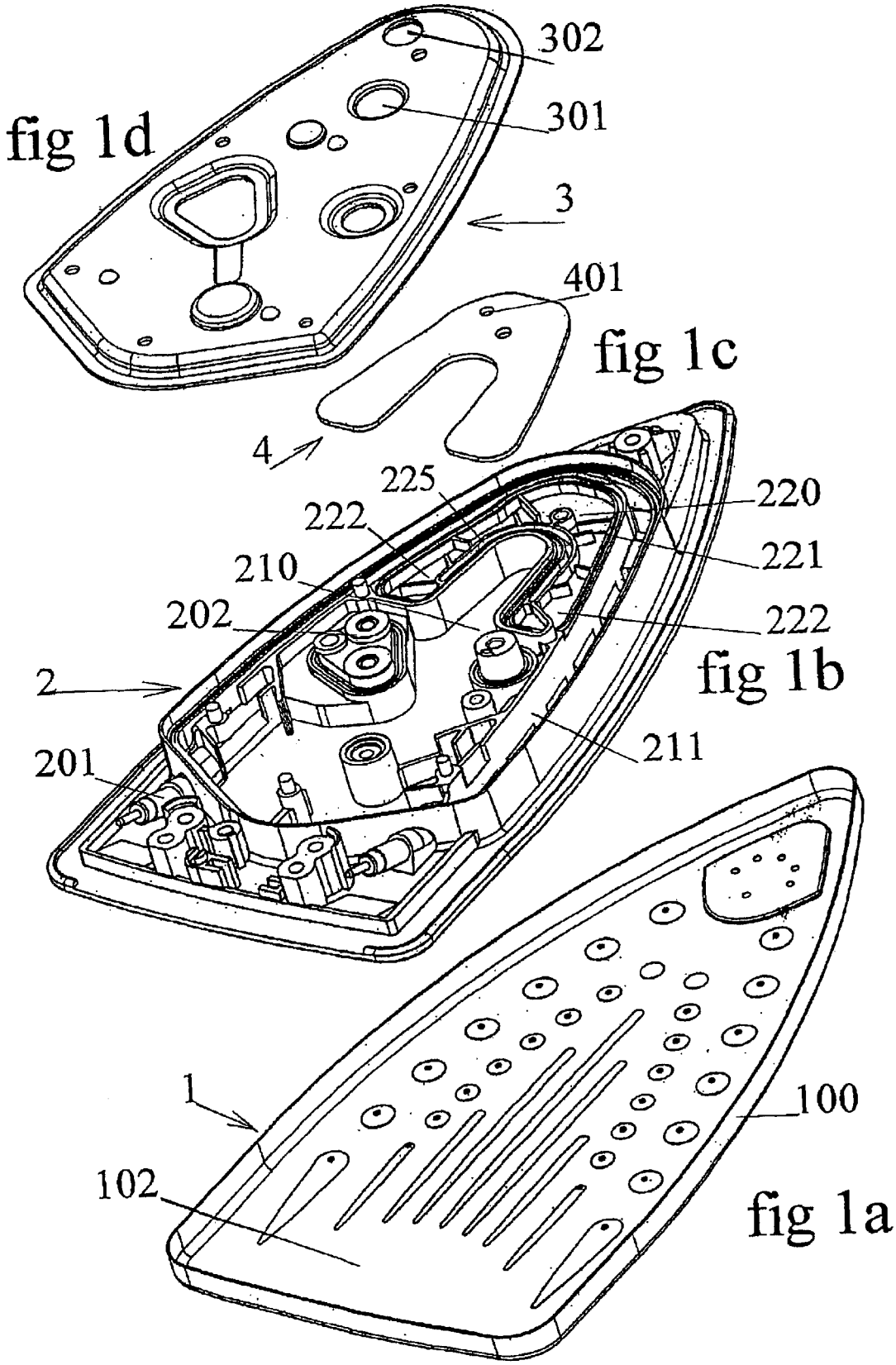

302
301

3
401

4
225
220
222
221
210
202
222

2
211
201
1
100
102

3
301
302

401
4

2
223
224
212
223

1
100
101
103
104

IRON WITH SURGE STEAM FUNCTION

This application is a 371 of PCT/IB01/01901 filed Oct. 12, 2001.

The present convention concerns steam irons having two separated steam chambers for the flash vaporization of water, each associated with a steam circuit that is terminated by a set of orifices for distributing steam beneath the soleplate.

Since the first steam irons only had a single steam chamber, manufacturers had to choose between continuous steaming with evacuation of the steam distributed over the ironing surface, or an abrupt vaporization under pressure, the vapor outlet being able to be concentrated in a smaller zone of the soleplate, for example at the tip of the soleplate as shown for example in the patent U.S. Pat. No. 2,700,236.

The more recent forms of irons with two separate steam chambers permit the two very different modes of operation due to the specialization of each steam chamber to a determined mode.

The patent EP 0342302, for example, describes an iron having first and second steam chambers, the second of which is in proximity to the tip of the soleplate and its set of orifices is concentrated at the tip of the soleplate. The iron functions according to a conventional ironing mode with the first chamber and in a mode of additional flash steam called surge steam, using the second steam chamber, this latter mode being more particularly useful to remove wrinkles from difficult places of the fabric being ironed.

Also known is the patent EP 0621365 which describes a similar iron having two steam chambers associated with two series of orifices in the ironing surface. The related patent FR 2740787 specifies the position of the second chamber and of the associated steam holes at the front of the soleplate.

But the second chamber abruptly receiving a substantial quantity of water to be vaporized is necessarily concentrated at the front of the soleplate to leave sufficient space for the normal vaporization, which leads this second chamber to be associated only with a steam circuit that is tortuous and passing in proximity to the vaporization walls of the first chamber, or is too short. Such a circuit that is remote from the heating element reheats the steam poorly, which does not guarantee a total evaporation of all of the water droplets, particularly when the user makes frequent use of one of the normal steam or surge steam functions before using the other steam function.

The following invention ameliorates these drawbacks.

The object of the invention is achieved by an iron having a soleplate with a heating body provided with a heating element, the heating element comprising a first steam chamber utilized for normal ironing and an independent second steam chamber utilized to obtain additional steam, each of these chambers being associated with a steam circuit terminated by a set of steam orifices in the soleplate, characterized in that the second steam circuit associated with the second chamber has along the heating element above the heating body an upper channel directed from the chamber toward the rear of the soleplate connected to a lower channel extending from the rear toward to the tip of the soleplate located beneath the soleplate heating body.

The path of the steam is thus elongated before its outlet onto the fabric being ironed. The heat exchanges between the steam and the soleplate have more time to take place and evaporation of the all of the drops of water is better assured.

Preferably, the steam circuit of the second chamber is isolated from the evaporation walls of the first chamber by a layer of air.

Use of the continuous vaporization in the first chamber does not cool the second chamber or its channels maintained hot in order to be able to obtain additional steam that is effective at any moment.

Preferably, the second steam chamber is on the axis of the soleplate and the steam circuit has second upper and lower channels, substantially symmetrical to the first.

One thus benefits from the symmetry of the heating body of the soleplate and of its heating element to efficiently increase the heat exchanges.

Preferably, the lower channels are joined together in their end part toward the tip of the soleplate.

This assures an equilibrium of the pressures in the lower channels to obtain a homogeneous vaporization on the articles being ironed.

Preferably, the steam orifices associated with the second chamber of the heating body open into the soleplate along lower channels and into their end part.

The ironing zone associated with the additional steam can then be extended by a layout adapted for the lower channels.

Preferably, the end junction of the lower channels is prolonged by an enlarged channel.

This arrangement permits more steam holes opening into the end part of the lower channels where the steam is better heated.

The invention will be better understood in view of the examples hereafter and the attached drawings.

FIG. 1 is an exploded view in perspective of an iron soleplate assembly according to the invention seen from above, comprising:

FIG. 1*a* which is a detail of FIG. 1 showing the soleplate of an iron according to the invention seen in perspective partially from above.

FIG. 1*b* which is a detail of FIG. 1 showing the heating body of the soleplate of the iron of FIG. 1 seen in perspective partially from above.

FIG. 1*c* which is a detail of FIG. 1 showing the closing plate of a steam chamber of the iron of FIG. 1 seen in perspective partially from above.

FIG. 1*d* which is a detail of FIG. 1 showing the closing plate of another steam chamber of the iron of FIG. 1 seen in perspective partially from above.

Figures 2A, 2B, 2C, 2D:
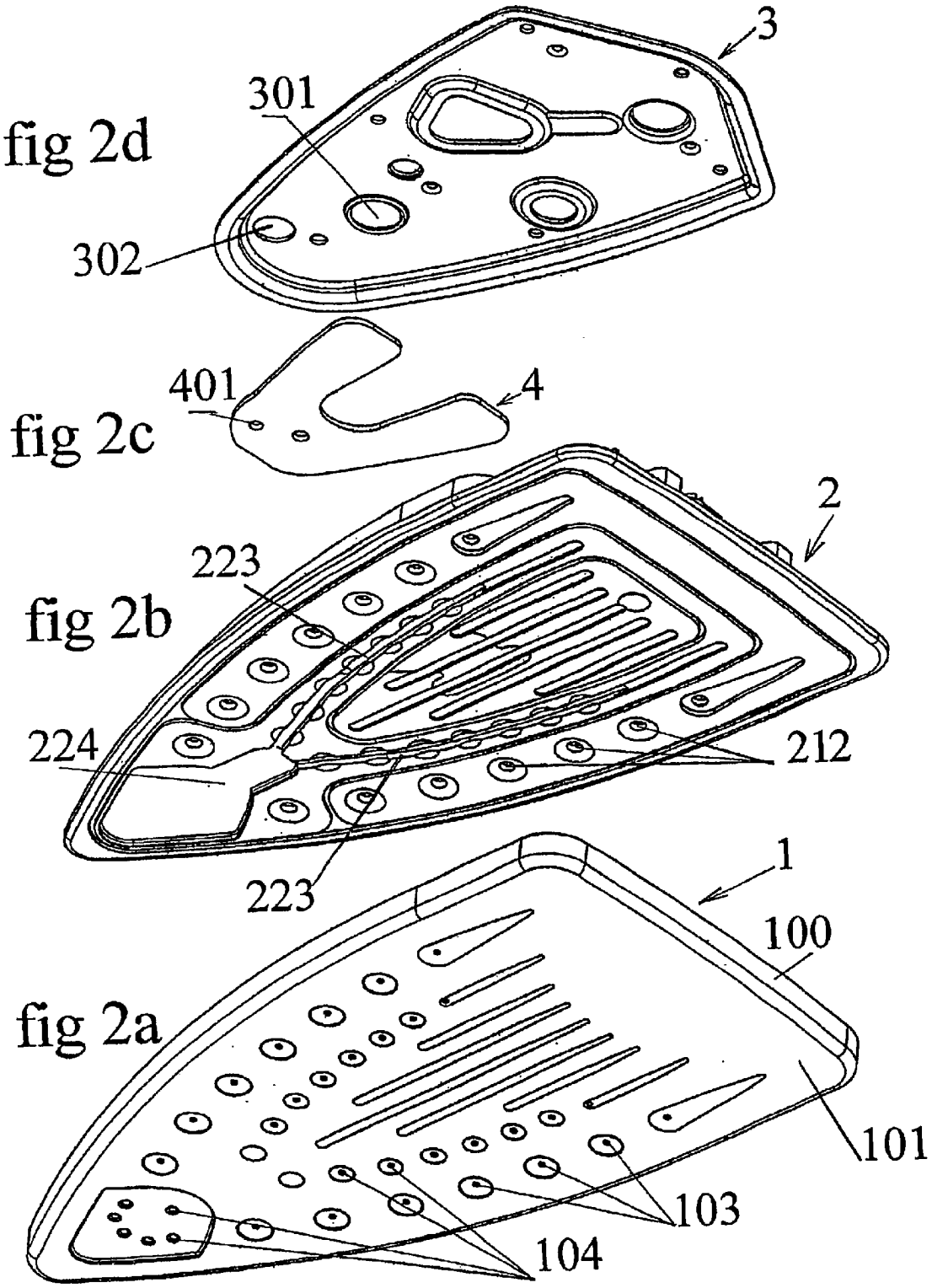

FIG. 2 is an exploded view in perspective of the iron soleplate assembly of FIG. 1 viewed from below, comprising:

FIG. 2*a* which is a detail of FIG. 2 showing the soleplate of the iron of FIG. 2 seen in perspective partially from below.

FIG. 2*b* which is a detail of FIG. 2 showing the heating body of the soleplate of the iron of FIG. 2 seen in perspective partially from below.

FIG. 2*c* which is a detail of FIG. 2 showing the closing plate of one steam chamber of the iron of FIG. 2 seen in perspective partially from below.

FIG. 2*d* which is a detail of FIG. 2 showing the closing plate of another steam chamber of the iron of FIG. 2 seen in perspective partially from below.

In a preferred version of the invention, the steam iron, having a form that is pointed in front, has a soleplate assembly visible in FIGS. 1 and 2. This subassembly situated conventionally below the water reservoir of the iron has a soleplate 1, a heating body 2, a closing plate 3 and another closing plate 4.

Soleplate 1 is a sheet stamped to have raised edges 100; the lower face 101 substantially flat and visible in FIG. 2, is the ironing face.

Heating body 2 comprises a resistive heating element 201 arched in the form of a horseshoe adapted in a continuous manner on the internal face 102 of the soleplate in order to be mechanically and thermally coupled thereto. At least one boss 202 is provided to receive a temperature regulation thermostat.

Heating body has in its upper part a first steam chamber 210 of large dimensions and closed by the closing plate 3. Water from the reservoir drips into this chamber 210 through orifice 301 of plate 3, is vaporized, and the steam distributed by channels 211 passes through body 2 in order to depart therefrom onto the fabric being ironed through holes 212 and corresponding holes 103 of soleplate 1.

Steam chamber 210 receiving water drop-by-drop produces steam for a normal and conventional ironing and its operation is known.

Heating body 2 also has at the front of its upper part a second steam chamber 220 surrounded by the steam circuit previously described and closed by plate 4. This steam chamber limited by ribs 221 is situated on the axis of the sole plate above an elbow of heating element 201. Two zigzag channels 222 prolong this second chamber while running, toward the rear of the soleplate, alongside heating element 201 and are connected at their end by a hole passing vertically through body 2 to two channels 223 located under the heating body. These channels 223 run alongside heating element 201 then are joined together toward the front of the iron where they are extended by an enlarged channel 224.

Advantageously, a deep groove 225, closed by plate 4, runs alongside the walls of chamber 210 close to which the water is vaporized drop by drop. This groove 225 immobilizes a layer of air. Chamber 210 is found thermally isolated by this layer of air from chamber 220 and from its steam circuit 221.

An orifice 302 is arranged in plate 3 and an orifice 401 is arranged in plate 4, these orifices permitting introduction of a water delivery tube into steam chamber 220. Preferably, the water arrives under pressure due to the action by the user on a pump.

In soleplate 1 steam outlet holes 104 are in alignment with channels 223 and 224. The steam circuit associated with second chamber 220 is thus totally independent of the steam circuit associated with first steam chamber 210.

When the user desires additional vapor she operates the pump associated with second steam chamber 220. Water arrives abruptly into this chamber and is vaporized due to the heat accumulated in the mass of the iron due to heating element 201 located immediately below chamber 220. Even if the iron has previously been used for a long time with normal steam, chamber 220 and its steam channels are hot since they are isolated from chamber 210 by groove 225. Steam escapes into zigzag channels 222 situated above the heating element in a massive part of body 2, while entraining drops with it. But due to the developed length of these channels, and to their thermal protection by groove 225, these drop vaporize completely therein. The steam then reaches lower channels 223 and the drops which were not able to do so sufficiently, notably as a result of an overly intensive use of the surge steam, continue to exchange heat with heating body 2. This exchange is that much more intense when, preferably, the channels are laid out in a manner to follow the path of heating element 201 in body 2. The path of the steam being prolonged by these means, the steam exits through holes 104 of soleplate 1 without any chance of carrying water drops onto the fabric being ironed.

Advantageously, the lower channels 223 are joined together at their end where steam is dry, which equilibrates the steam pressures and homogenizes the action on the fabric. The reunited channels can without difficulties be extended by a single channel capable of being associated with steam holes 104 situated at the locations where two channels would not be justified and would not have room such as at the front of the iron.

By these means, one obtains an excess of effective steam, permitting an intensive use of this ironing mode without risking droplets and run-outs on the fabric.

What is claimed is:

1. Iron having a soleplate (1) with a heating body (2) provided with a heating element (201) that extends along a path, the heating element (2) comprising a first steam chamber (210) utilized for normal ironing and an independent second steam chamber (220) utilized to obtain additional steam, each of these chambers being associated with a steam circuit terminated by a set of steam orifices in the soleplate, characterized in that the second steam circuit associated with the second chamber (220) has along the heating element (201) above the heating body (2) an upper channel (222) directed from the chamber toward the rear of the soleplate and a lower channel (223) connected to the upper channel and extending from the rear toward to the tip of the soleplate located beneath the soleplate heating body, the lower channel following the path of the heating element.

2. Iron having a soleplate (1) with a heating body (2) provided with a heating element (201), the heating element (2) comprising a first steam chamber (210) utilized for normal ironing and an independent second steam chamber (220) utilized to obtain additional steam, each of these chambers being associated with a steam circuit terminated by a set of steam orifices in the soleplate, characterized in that the second steam circuit associated with the second chamber (220) has along the heating element (201) above the heating body (2) an upper channel (222) directed from the chamber toward the rear of the soleplate connected to a lower channel (223) extending from the rear toward to the tip of the soleplate located beneath the soleplate heating body, and further characterized in that the steam circuit of the second chamber (220) is isolated from the evaporation walls of the first chamber (210) by a layer of air (225).

3. Iron according to claim 2 characterized in that the second steam chamber (220) is on the axis of the soleplate and the steam circuit has second upper (222) and lower (223) channels, substantially symmetrical to the first.

4. Iron according to claim 3 characterized in that the lower channels (223) are joined together in their end part toward the tip of the soleplate.

5. Iron according to claim 4 characterized in that the steam orifices (104) associated with the second chamber (220) of the heating body (2) open into the soleplate (1) along lower channels (223) and into their end part.

6. Iron according to claim 5 characterized in that the end junction of the lower channels (223) is prolonged by an enlarged channel (224).

* * * * *